United States Patent [19]

Johnson et al.

[11] Patent Number: 4,748,782

[45] Date of Patent: Jun. 7, 1988

[54] SELF-ALIGNED AND LEVELED INSULATED, DRYSTACK BLOCK STRUCTURES AND MEANS AND METHODS THEREFOR

[76] Inventors: Stanley D. Johnson, 8230 East Valley Vista Drive; Weldon R. Johnson, 8226 East Keim Drive, both of Scottsdale, Ariz. 85253

[21] Appl. No.: 63,136

[22] Filed: Jun. 16, 1987

Related U.S. Application Data

[63] Continuation-in-part of Ser. No. 620,448, Jun. 14, 1984.

[51] Int. Cl.[4] ..... E04C 01/40

[52] U.S. Cl. ..... 52/405; 52/221; 52/309.12; 52/586; 52/593; 52/606; 52/747; 52/809

[58] Field of Search ..... 52/606, 309.12, 309.9, 52/405, 749, 747, 586, 593, 221, 565, 809

[56] References Cited

U.S. PATENT DOCUMENTS

| | | | |
|---|---|---|---|
| 1,270,541 | 6/1918 | Mueller | 52/98 |
| 2,172,053 | 9/1939 | Robbins | 52/405 |
| 2,852,934 | 9/1958 | Amundson | 52/405 |
| 3,204,381 | 9/1965 | Perreton | 52/606 |
| 3,546,833 | 12/1970 | Perreton | 52/405 |
| 4,348,845 | 9/1982 | Iannarelli | 52/309.9 |
| 4,380,887 | 4/1983 | Lee | 52/405 |
| 4,516,364 | 5/1985 | Heider | 52/98 |

FOREIGN PATENT DOCUMENTS

| | | | |
|---|---|---|---|
| 2440466 | 3/1976 | Fed. Rep. of Germany | 52/405 |

*Primary Examiner*—John E. Murtagh

*Attorney, Agent, or Firm*—LaValle D. Ptak

[57] ABSTRACT

Means and methods for constructing drystacked self-aligning self-leveling walls and like structures. A novel construction block has interior, tapered wall cells bounded by transverse webs having an extended V-shaped draft defined therein. The tapering of the walls provides precisely maintained interior geometry. Insertable cores of precise dimension and having V-shaped ear members adapted to fit intimately within such V-shaped draft or groove and to cooperatively coact with like cores in adjacent blocks in a running course to establish a fixed spatial relationship between the top surface of the core and the bottom surface of the block to permit erection of a self-aligned and self-leveling standing wall from drystacked block. The intimate contact of the insertable cores permit the formation of open-gapped interlocks between blocks and running courses, which open-gapped interlocks are converted to closed-gapped interlocks when a wall erected of such running courses is coated with a surface bonding cement. A method of creating such a structure is described.

21 Claims, 3 Drawing Sheets

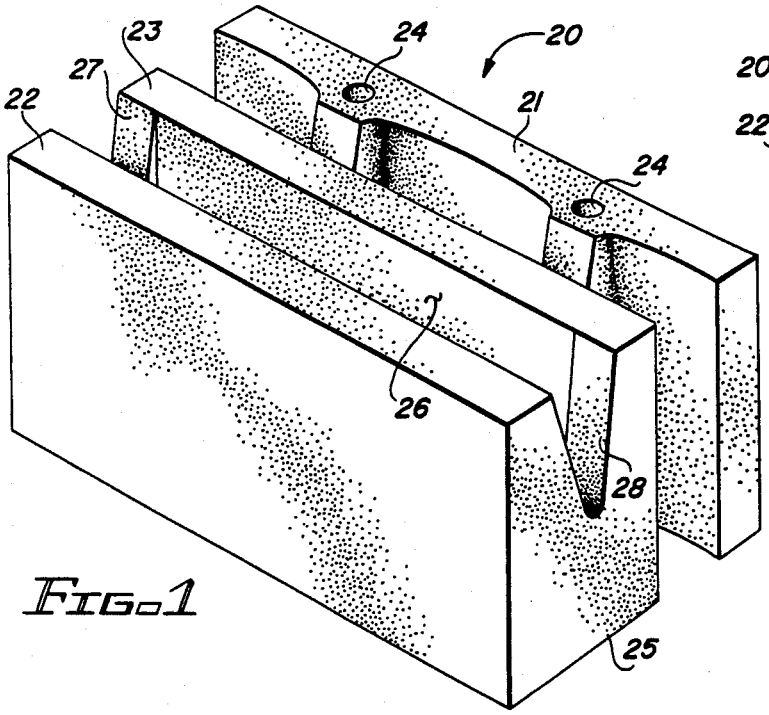
FIG. 1
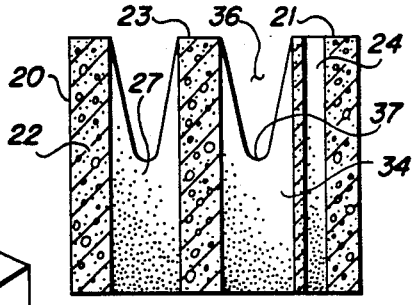
FIG. 6
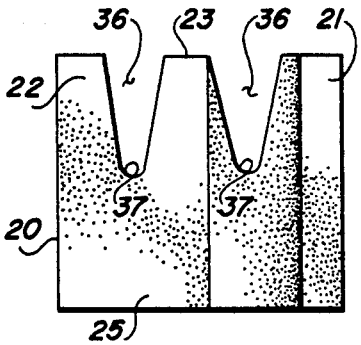
FIG. 5
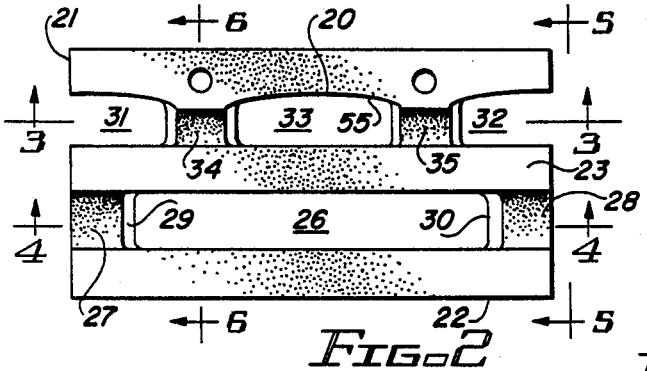
FIG. 2
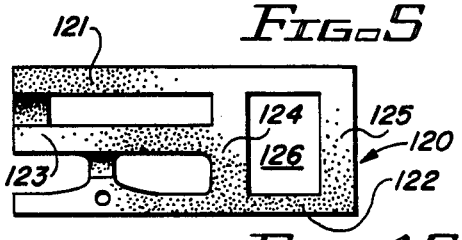
FIG. 15
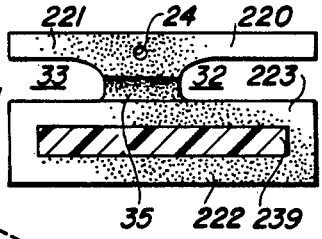
FIG. 16
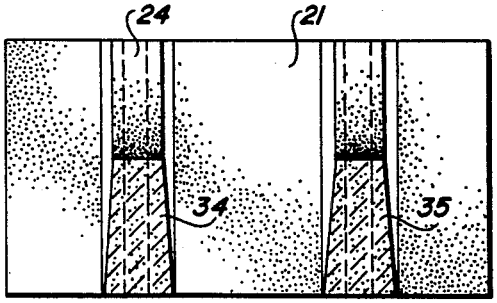
FIG. 3
FIG. 4
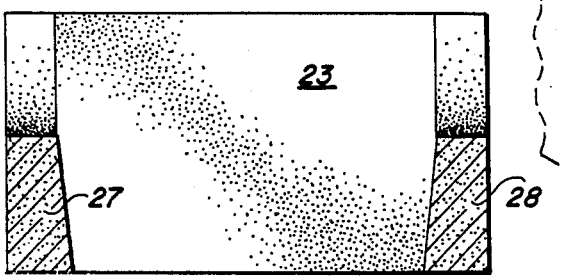
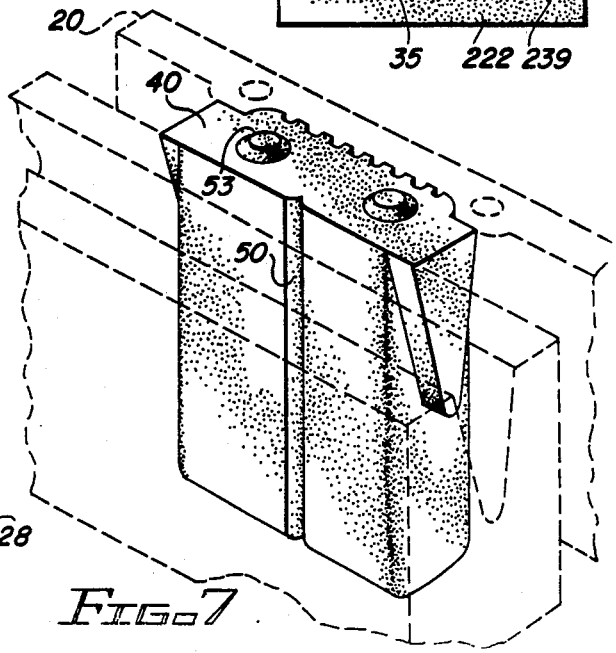
FIG. 7

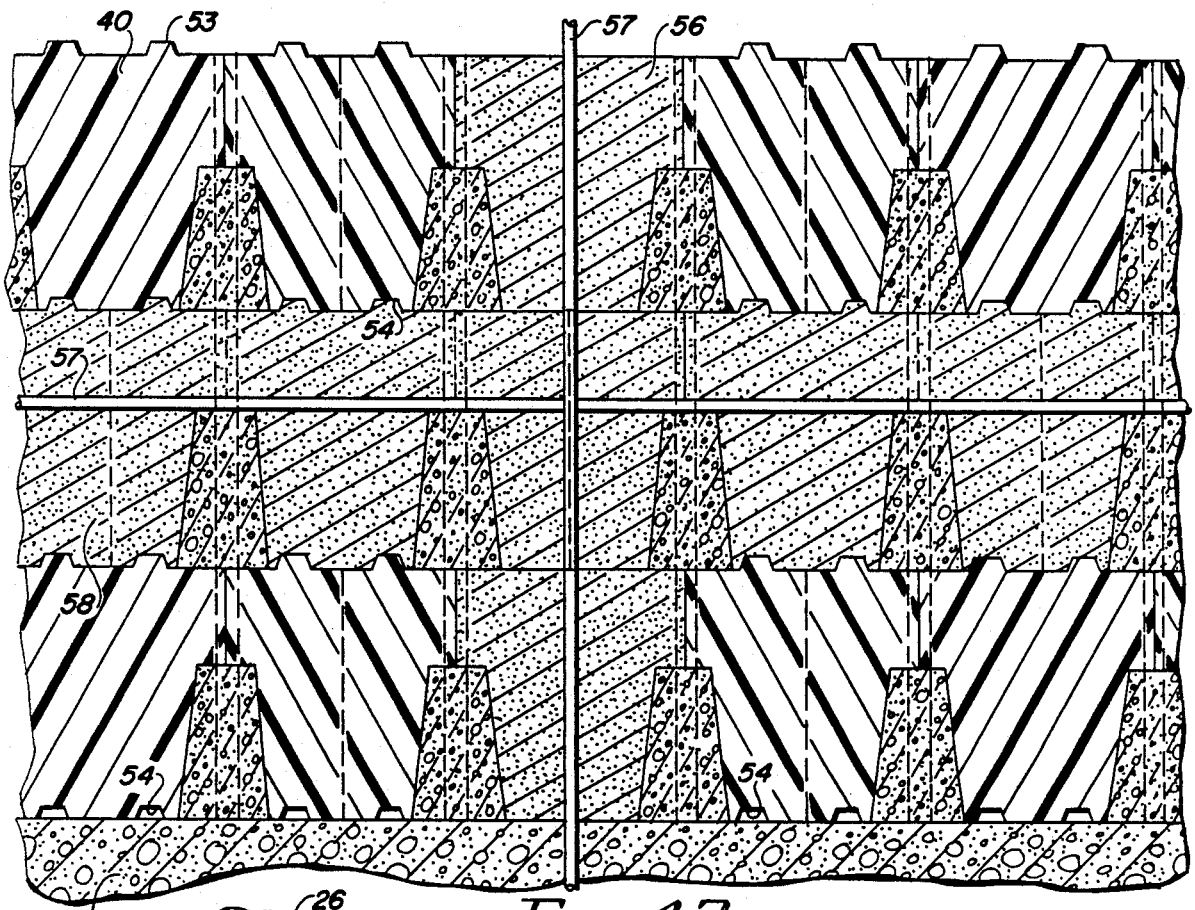
FIG. 12
FIG. 13
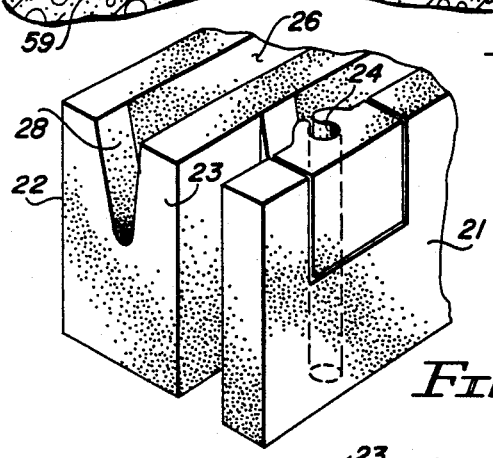
FIG. 14A
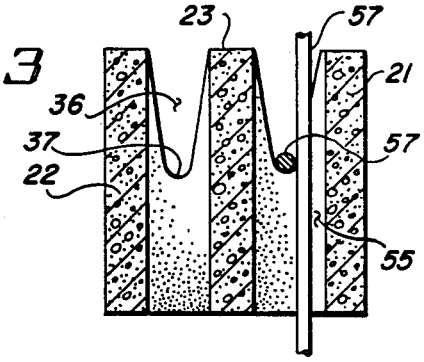
FIG. 14C
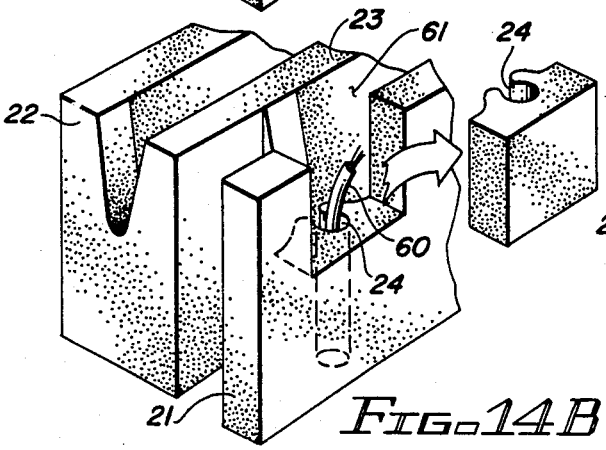
FIG. 14B
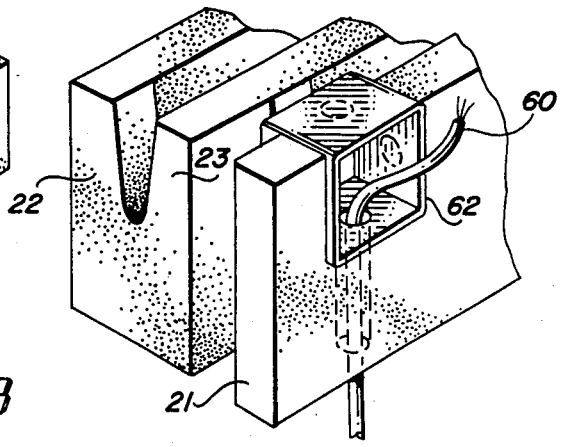

SELF-ALIGNED AND LEVELED INSULATED, DRYSTACK BLOCK STRUCTURES AND MEANS AND METHODS THEREFOR

RELATED APPLICATION

This application is a continuation-in-part from U.S. application Ser. No. 620,448 filed June 14, 1984 for Self-Aligned and Leveled Insulated Drystack Blocks.

INTRODUCTION

The invention relates to drystack construction blocks, i.e., blocks which may be stacked in running courses to erect a free-standing wall without the use of mortar. More particularly, the present invention relates to drystacked construction block and methods of using them which includes therein means for aligning and leveling a running course of said block without employing extraneous equipment or mortar.

BACKGROUND OF THE INVENTION

Intrareactive construction blocks are known and include blocks having projecting tongues or spurs which mate with complementary channels or grooves disposed in an adjacent block. While such spurs and channels may increase the mechanical integrity of a wall structure assembled from such blocks, the creators thereof invariably ignored the fact that construction block is generally cast into a mold and that the highly abrasive nature of the concrete employed in molding such block causes rapid and severe erosion in the mold. Further, the machines themselves lend to dimensional inaccuracies because they employ two parts which are not truly aligned during the block manufacturing process. As a result, the dimensions of block produced by these molds are not precise, that is, the blocks tend to become greater in both length and thickness the longer the mold employed to manufacture them is used, and schemes predicated upon absolute uniformity of the block just do not fulfill expectations.

Furthermore, some of the prior art construction block was provided with interior passageways suitable for housing subsequently installed electrical conduit. However, unless the mason erecting the wall knew exactly where the electrical runs were to be installed after the structure was completed, the passageways were essentially useless.

Other prior art construction blocks had hollow cells which could be filled with insulating material and the like during manufacture. However, when such cells were prefilled and the block was stored in the yard pending shipment, the insulating material frequently deteriorated in reaction to ultraviolet rays and the like impinging thereon and many of the blocks were rendered unsuitable for subsequent use.

It is therefore apparent that many of the prior art blocks which purported to provide dimensional stability and insulatability were shown to be impractical in actual use because the peculiarities of the block design prevented the ready construction of a wall which would meet all of the requirements of the Uniform Building Code, particularly, those regulations requiring bond beams, grout cells and like core-size requirements.

BRIEF SUMMARY OF THE INVENTION

The present invention relates to both means and methods of resolving these prior art problems. In particular, a method is set forth for erecting a drystack block wall which is self-leveling and self-aligning. The means and methods involve a unique hollow celled block and precisely dimensioned interlocking cell cores which, when inserted within selected hollow cells of the blocks, coact with abutting surfaces of adjacent cores to create a stable, level and plumbed wall. A cell core, disposed in preselected hollow cells of each block in one running course of block, coact with the cell core superjacent thereto in the next running course of the wall to achieve our unexpected result. As will appear, the controllable precise dimensions and unique characteristics of the cell cores hereof and the coaction of those cell cores with the special V-shaped grooves disposed in the transverse webs of the block to expose about ⅛ inch of the cell core allows uneven block to settle to the highest point of compression and thereby create a wall which is both vertically and horizontally aligned.

The method hereof and means for use therewith comprises providing a level base surface on a preselected course; placing a plurality of hollow cell blocks end-to-end on a first row along that course, each of the blocks having a preselected length, width, and height, a first and second outer wall and a central wall or web, the central wall being operatively interposed between the first and second outer wall and presenting a first and second planar surface respectively thereto to define first and second core receiving slots or cells therebetween, the first core receiving slot having a first and a second web disposed transversely thereacross at each end thereof in spaced parallel relationship to each other, the second core receiving slot having a third and a fourth web disposed transversely thereacross in spaced parallel relationship to each other intermediate the ends thereof and coacting therewith to define a first and second open ended compartment adjacent the ends thereof and a relatively closed compartment intermediate the open compartments between said webs, each of the transverse webs having a V-shaped notch defined therein, the notch having its apex disposed in a fixed preselected spatial relationship to the bottom surface of the block, the blocks being oriented on the course so that the open ended compartments of adjacent blocks are in registered communication with each other adjacent the intended interior surface of the wall; placing a first spacer core in each first core receiving slot in each block in seated engagement therewithin, each first spacer core having a body portion substantially equal in size to the first core receiving slot and V-shaped ear members integrally formed with the body portion at each end thereof for seated engagement within the V-shaped notch of the transverse web contiguous thereto; placing a second spacer core in said relatively closed compartment in the second core receiving slot in seated engagement therewithin, each spacer core having a body portion substantially equal in size to the relatively closed compartment but thicker than said first spacer core, the second spacer core having a V-shaped ear member integrally formed with the body portion at each end thereof for seated engagement within the V-shaped notch of the transverse web contiguous thereto, each ear member extending outwardly from the body portion a distance equal to one-half the axial length of the V-shaped slot; placing a third spacer core in one of the open compartments in the second core receiving slot and the registered open compartment in the block adjacent thereto to interlock the adjacent blocks in fixed axial relationship to each other, the third spacer core being substantially identical in shape and size to the second spacer core and the V-shaped ears thereof being seated in said V-shaped slots of the transverse webs contiguous thereto; each of the spacer cores having a first planar surface and a second fluted surface on opposite sides of the body portion thereof, the second fluted surface engaging with and reacting to the adjacent surface of the compartment to which it corresponds to create a shape-conforming friction fit therewithin and create a surface-to-surface engagement between the first surface and the compartment surface adjacent thereto; repeating the foregoing steps until the entire first row of blocks and spacer cores are in place along the course; and repeating the entire sequence for the second and subsequent row of blocks along said course until the preselected length and height of the desired wall is achieved.

As will be hereinafter described in detail, the means and methods of the present invention overcome the several problems of the prior art in a remarkably unexpected fashion.

Accordingly, it is a prime object of the present invention to provide means and methods to effectively compensate for the inherently inaccurate dimensional characteristics of molded block and provide a drystacked construction block system which has precise dimensional characteristics.

A further object of the present invention is to impart predetermined and precise configuration characteristics into a unique construction block which enables such blocks when assembled with unique cell core inserts strategically disposed therein to create running courses which are of constant, predeterminable lengths and in which each individual block is self-aligning and self-leveling.

Another object of the present invention is to provide new and improved self-leveling and self-aligning blocks and inserts therefor which when assembled in running courses substantially reduce thermal transfer between one outer wall of the construction block and the other outer wall thereof.

A still further object of the present invention is to provide new and improved means and methods for drystack block construction which is readily adaptable to providing full insulative barriers around doors and windows and avoids the use of the solid end blocks required by the prior art.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

BRIEF DESCRIPTION OF THE DRAWINGS

In the drawings:

FIG. 1 is an isometric view of a building block embodying the present invention;

FIG. 2 is a plan view of the block shown in FIG. 1;

FIG. 3 is a cross-sectional view taken along line 3—3 of FIG. 2;

FIG. 4 is a cross-sectional view taken along line 4—4 of FIG. 2;

FIG. 5 is a view taken along line 5—5 of FIG. 2;

FIG. 6 is a cross-section view taken along line 6—6 of FIG. 2;

FIG. 7 is an isometric view of a block insert embodying the present invention showing a fragmented block (in phantom) associated therewith;

FIG. 12 is a partially sectioned front elevation of a portion of a wall constructed to provide a grout cell in accordance with the present invention;

FIG. 13 is a sectioned end elevation view of a block assembled pursuant hereto showing vertical and horizontal rebar placed therein;

FIG. 14A is an isometric view of a fragmented block embodying the present invention showing a cut for gaining access to electrical conduit means integrally formed therewith;

FIG. 14B is an isometric view of the block of 14A with the cut out removed and cable extending through said conduit means;

FIG. 14C is an isometric view of the block of 14B with the electrical box in place and the cable extending therethrough for operative hook-up in accordance with the present invention;

FIG. 15 is a plan view of a corner block adapted for use with the present invention;

FIG. 16 is a plan view of a half-block embodying the present invention; and

DESCRIPTION OF PREFERRED EMBODIMENTS

Figure 8:
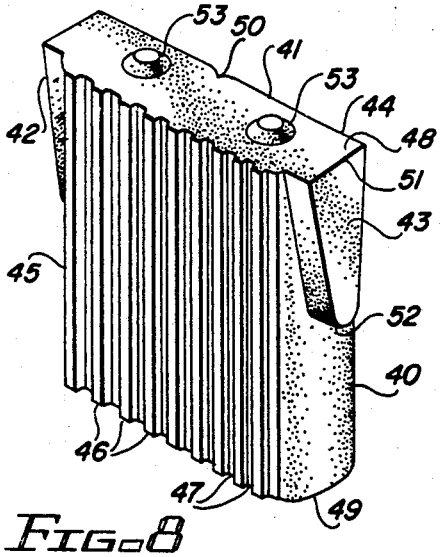
FIG. 8 is a perspective view of a smaller core unit made in accordance with the present invention.

Referring to the drawing, and more particularly to FIGS. 1–6, a construction block embodying the present invention is identified at 20 and comprises a first and second outside wall, 21 and 22 respectively, separated by central web 23. One outside wall, e.g., wall 21 contains a pair of conduit channels 24 which are symmetrically disposed so that when blocks 20 are arranged in running courses, conduit channels 24 in a first running course will align with conduit channels 24 in the second running course and so on.

Outer wall 22 and central web 23 define a tapered core cell 26 therebetween, the purpose of which will be hereinafter described in detail. Operatively interposed between wall 22 and central web 23 are transverse webs 27, 28, respectively, which define the longitudinal bounds of cell 26. As is seen in FIG. 2, the interior surfaces 29, 30 of transverse webs 27, 28, respectively, are also tapered so that cell 26 is fully tapered. When block 20 is cast, the mold part employed to form cell 26 will contain complementary taper which complements those of the interior surface of wall 22, the facing surface of central web 23 and surfaces 29, 30 of transverse webs 27, 28.

The space between central web 23 and wall 21 contains two open-ended, tapered core cells 31, 32 separated by tapered central core cell 33. The tapered walls of the individual cells are created by tapering the inwardly facing surfaces of central web 23 and wall 21. Transverse webs 34, 35, each having reduced height, are disposed at each end of central cell 33 and define the boundary between cell 33 and cells 31, 32, respectively.

As shown in FIGS. 2 and 3, transverse webs 27, 28 are disposed outwardly from transverse webs 34, 35 so that a single transverse plane does not pass between web 27 and web 34 or between web 28 and web 35. The height of transverse webs 27, 28, 34 and 35 is deliberately reduced and typically, stand slightly more than one-half the height of block 20. Webs 27, 28, 34 and 35 are especially designed to enable block 20 to have the strength necessary to meet the various building codes while the reduced height of the webs reduces the volume of the thermal conduction path and hence the thermal transfer between walls 21 and 22. Each web 27, 28, 34 and 35 is provided with a V-shaped groove or hyperextended draw 36 which converges to a curvilinear crotch 37, the function of which shall hereafter be described in detail. Nonetheless, it should be noted that the V-shaped draw 36 enables the manufacturer to obtain proper compression during the molding process with stronger compaction and avoids the fracture points which inevitably result if the draw terminated in a square bottom.

As further shown in FIGS. 1, 2 and 3, each conduit channel 24 defines a cylindrical pathway through which electrical wiring may be passed and accessed as is hereinafter described in detail in connection with FIGS. 14A, 14B and 14C.

Figure 9:
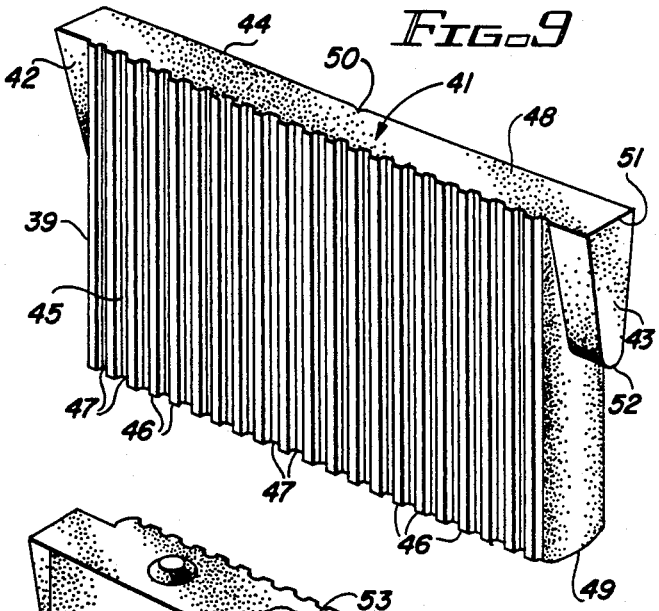
FIG. 9 is a perspective view of a larger core unit made in accordance with the present invention.
Figure 10:
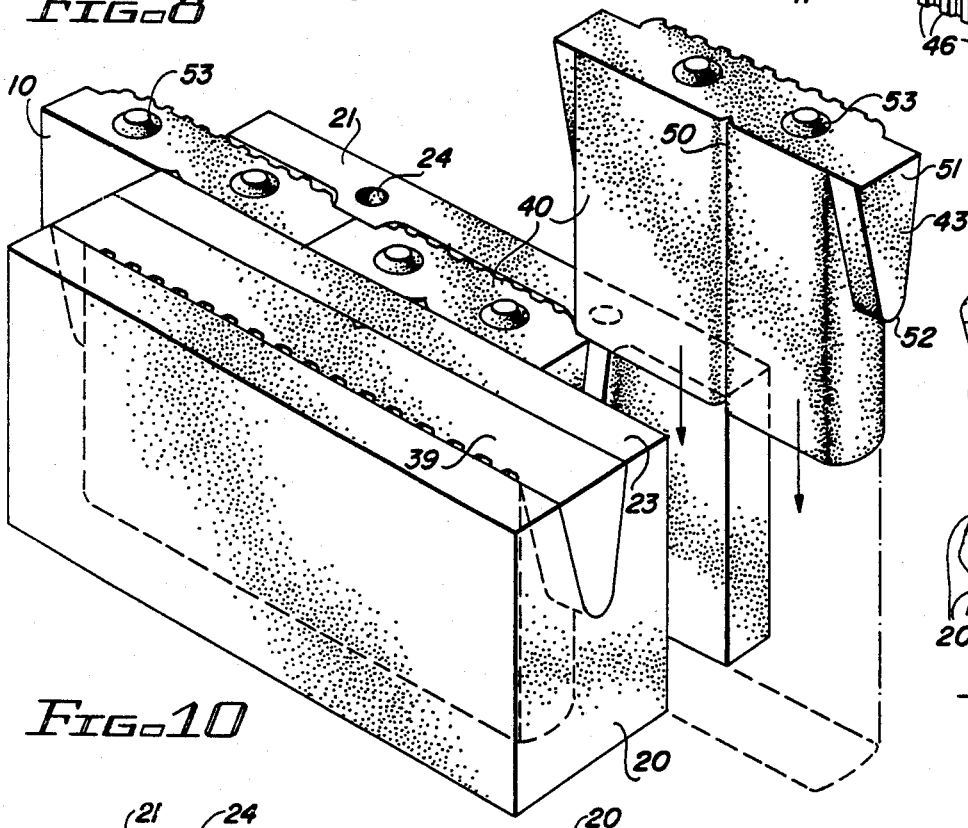
FIG. 10 is an isometric showing, partially in phantom, of a building block and core assembly embodying the present invention.

Having thus described a construction block 20 whose interior dimensions can be effectively replicated throughout long manufacturing runs, refer now to FIGS. 8, 9 and 10 wherein the cell cores which when installed in accordance with the present invention, cause the structure created thereby to be self-aligning and self-leveling when layed in running courses to create a standing wall.

As shown in FIG. 10, a longer cell core 39 is disposed within cell 26 in shape-conforming relationship thereto while shorter cell cores 40 are disposed in shape-conforming relationship to cells 31, 32 and 33. As used hereafter, longer core 39 will be referred to as a "first" core. Whereas shorter core 40 will be referred to as "second" or "third" core depending on its precise location in the assembly. While cores 39 and 40 may be molded of any material which allows precise control of its dimensional characteristics, in a preferred practice, cores 39, 40 will be formed of an insulating material such as, for example, a low-density foam such as expanded polystyrene or the like whereupon the rate of thermal conduction through the resultant block wall is substantially reduced.

While, as will be explained, the axial length of cell cores 39, 40 vary, the principal construction of the cell cores will be preferably the same, that is, each will comprise a body portion 41 having a first and second ear-like portion 42, 43, respectively disposed at each end thereof. In practice, the axial length of cell core 40 is about one-half the axial length of cell core 39 for reasons to be hereinafter described in detail. For ease in identification, core 39 will be identified herein as the "longer core" and core 40 as the "shorter core".

Each core, for example shorter core 40 as shown in FIG. 8 (see FIG. 9 for longer core 39), comprises a body portion 41 having a first ear 42 disposed at one end thereof and integrally formed therewith and a second ear 43 integrally formed at the other end thereof. Body portion 41 comprises a generally vertical, planar surface 44 and a bowed inwardly tapering surface 45. Surface 45 is provided with a plurality of spaced generally parallel vertically extending ridges 46 having a concave valley portion 47 operatively interposed therebetween and extending from the top surface 48 of body portion 41 to the bottom surface 49 thereof. The interaction of ridges 46 with their adjacent valleys 47 will herein be referred to as "fluting" and provides a unique reaction with the adjacent surface of the receiving cell to create a "custom fit" of the core therewith. Body portion 41 is appropriately scored at its horizontal mid point, designated score line 50, which extends the full height of the core for purposes which will become apparent from later description.

Each ear member, for example, ear 42 defines a V-shaped portion having its widest dimension 51 in substantially co-planar relationship with core top surface 48 and extending downwardly therefrom for a distance sufficient to enable that distance plus the distance between the crotch 37 of the V-shaped groove 36 defined in each of transverse webs 27, 28, 34 and 35 and the bottom surface 25 of block 20 to provide a substantially uniform and duplicatable dimension between block surface 25 and core top surface 48 every time a core is inserted into a core cell.

Stated another way, the hyperextended draft or V groove 36 provided in each transverse web 27, 28, 34 and 35 uniquely eliminates abrasion of the mold part during the post-compaction release from the form and, during manufacture, significantly enhances the strength of the transverse webs and hence the structural integrity of the block itself. More importantly, it maintains a substantially uniform and hence replicable dimension between the curvilinear crotch 37 in the V-shaped groove 36 and the bottom surface 25 of block 20 so that when ear members 42, 43 as hereinafter detailed, are seated in their corresponding V-shaped groove 36, the distance between the lower point or nose 52 of each ear member 42, 43 and the bottom surface 25 of block 20 is the same.

Figure 11:
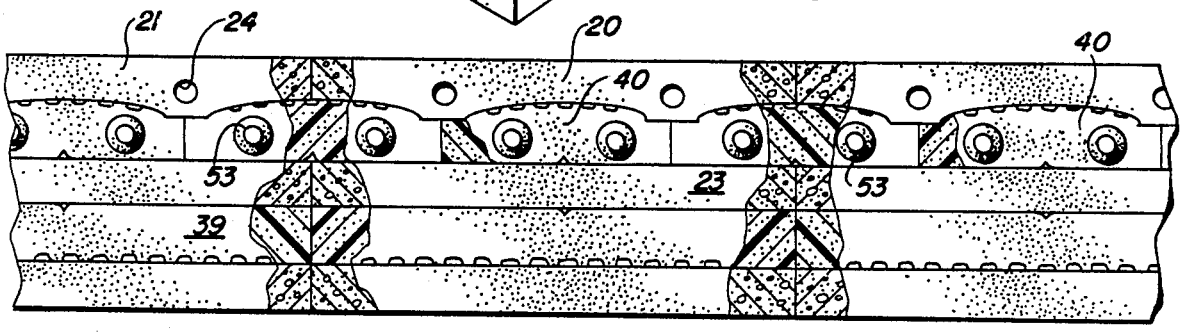
FIG. 11 is a fragmented plan view of three abutting blocks having spacer cores in place and arranged in accordance with the present invention.

As shown in FIGS. 10 and 11, continuous central web 23 or wall of each unique block 20 employed herewith enables both halves of block 20 to be insulated by the insertion of the appropriate cell core 39 or 40 therein or only one-half to be insulated while the other half is filled with aggregate to enhance the strength of the wall and provide that wall with thermal flywheel when warranted or desired. Modifications for the inclusion of reinforcing bars, grout cells, bond beams, and electrical conduit therewithin or the application of surface bonding cement thereto is described later.

As earlier described, each improved building block 20 has first and second outside walls 21, 22 and a central web 23 operatively disposed therebetween in spaced generally parallel relationship to outside walls 21, 22. Central web or wall 23 coacts with one wall, e.g., wall 21 to define tapered core receiving cells 26, therebetween and coacts with another wall, e.g., wall 22 to define core receiving cells 31, 32 and 33 therebetween during the molding of the blocks.

As previously mentioned, one of the more imprecise dimensions of a molded construction block is the height of the block. The height of the block varies with the amount of material impressed into the mold from which the block is manufactured. Molded construction block therefor has a tendency to run slightly undersized from a standard height dimension, for example, eight inches.

However, this inaccuracy is completely compensated for by the ability to maintain precise control of the height of cores 39 and 40 and the dimension of ear members 42, 43 integrally formed thereupon. Thus, a fixed and precise height dimension is established for the combination of a block 20 and one or more cores 39, 40 when inserted therein with ear members 42, 43 firmly seated within the corresponding hyperextended draft or V-shaped groove 36 provided in each transverse web 27, 28, 34 and 35. Further the tapering of the walls of the individual cells 26, 31, 32 and 33 in block 20 enables blocks to be produced in which substantially exact interior dimensions are maintained so that the precisely dimensioned fluted cores 39, 40 will intimately fit therewithin and permit the construction of a true and level standing wall therefrom.

With reference to FIGS. 1, 2, 9 and 10, core 39 is disposed in core cell 26 and extends axially therealong whereupon ears 42, 43 are firmly seated in the V-shaped groove 36 defined respectively in webs 27, 28. As shown in FIG. 10, with reference likewise had to FIGS. 1, 2, 7 and 8, core 40 is disposed intimately within cell 33 in shape-conforming relationship to the tapered walls of the cell. The fit of core 40 in cell 33 is enhanced by the light "sanding" action on ridges 46 caused by the harder inner surface of the cell as ears 42, 43 are firmly seated in the V-shaped groove 36 defined respectively in webs 34, 35. For reasons which shall become apparent, ear members 42, 43 of shorter cell core insert 40 occupy only one-half of the axial length of the grooves 36 in the contiguous webs 34, 35 in contrast to the corresponding ear members 42, 43 of the longer core 39 each of which extend completely across the grooves 36 defined in contiguous webs 27, 28. Additional shorter cell cores 40 are disposed into each of the open-ended cells 31, 32 in intimate shape-conforming engagement with the interior walls of its corresponding cell as well as extending into intimate abutting contact with a portion of an adjacent like core 40. When a cell core 40 is disposed in one of the open-ended cells 31, 32, approximately one-half of the core 40 will extend beyond the bounds of the associated cell 31, 32 into the open-ended cell 31, 32 of the concrete block 20 (see FIGS. 10, 11 and 12) adjacent thereto and in registry therewith.

By extending selected cores 40 beyond the longitudinal bounds of the principal block 20 into the adjacent block, a slight ($\frac{1}{8}$ inch) gap is produced between the facing ends of adjacent blocks 20 which serves to collect concrete crumbs and assure that the molded cores will ultimately control the critical dimensions of the assembled structure and eliminate the vagaries of length created by mold wear in the manufacture of block. In practice, the gap between adjacent concrete blocks will be approximately one-eighth of an inch when the blocks are set in running courses to erect a standing wall. In one preferred practice, longer core 39 will measure sixteen inches and shorter core 40 will measure eight inches in length.

Since drystacked blocks employed in the erection of a standing wall are generally coated with a surface bonding cement, the slight gap between blocks 20, as described above, will readily accept surface bonding cement therein to provide a strong gapless interlock therewith and enhance the shear strength of the standing wall resulting therefrom. A typical surface bonding cement found to provide especially desirable results when used in conjunction with the present invention is described in United States Department of Agriculture Bulletin No. 374 and is commercially available (e.g., Q-Bond ®, J.T.L. Company, Denver, Colo.).

The intimate line contact maintained between adjacent cores 39 and between adjacent core 40 within a running course of blocks 20 further enhances the thermal resistivity of a standing wall constructed therefrom, especially when the cores are made of an insulative material.

Referring now to FIGS. 7, 8, 11 and 12, each smaller core 40 is provided with a pair of nodes or spurs 53 on the top thereof and complementary recesses 54 on the bottom thereof, which, as will be explained, coact with one another to create an interlock when a structure is assembled using blocks 20 and cores 40 in accordance herewith.

When blocks 20 with cores 40 inserted therein are layed in running courses, each spur 53 will matingly interlock with a complementary recess 54. The interlocking of the several spurs 53 with their corresponding recesses 54 prevents individual blocks from skewing and thus contributes to the self-alignment of the blocks in a running course. Further, the interlocking of the spurs 53 and recesses 54 complements the stabilizing action of cores 40 which extends from the open cells 31, 32 in one block into the contiguous open cell in the block adjacent thereto.

Sectional view of the standing wall shown in FIG. 12 also illustrates the ease with which the invention may be adapted to accommodate local building codes. Thus, when local building codes require there be a continuous vertical grout column approximately every four feet along the running length of the wall, such a column is readily created by selectively omitting cores 40 in a vertically aligned series of short cells 31, 32 or 33 to create a continuous vertical void in the standing wall so erected. Thereafter a vertically extending reinforcing bar 57 can be readily placed within the void thus created when required to comply with local building code standards and thereafter the void is filled with a continuous vertical column of grout, shown as grout cell 56 in FIG. 12. Preferably, reinforcing bar 57 when used is inserted into the void established by the removal of the cores. The grout is thereafter filled into the voids around the bar 57 to establish a reinforced grout cell 56.

Many local building codes also require that a bond beam be established, for example, one disposed in each four feet of height of the standing wall. Such a bond beam 58 (see FIGS. 12 and 13) is readily created when using the present invention and comprises a continuous horizontal beam of grout formed by removing of all cores 40 from a given running course of block, laying a horizontally-extending reinforcing bar 57 in the curved crotch 37 of the several webs 34, 35 so as to extend across several cells 31, 32, 33 and thereafter filling the void remaining with grout. The cores 40 which are disposed in the course of block 20 beneath bond beam 58 prevents the grout from migrating downwardly from the bond beam 58 into lower portions of the standing wall and eliminates the need for grout mesh. Bond beam 58 will set and lock itself to the spurs 53 protruding from cores 40 disposed therebeneath thereby contributing further to the strength and stability of the wall created thereby.

As shown in FIG. 13, rebar 57 can be readily disposed both vertically and horizontally within cells 31, 32 and 33. The reduced height of transverse webs 34, 35 and the curvilinear crotch 37 defined therein permits the precise placement of a horizontally extending reinforcing bar 57 within the confines of a course of blocks 20. Further, the juncture of each cell 31, 32, 33 with its correspondingly adjacent web 34, 35 creates a nook 55 into which a vertically extending rebar 57 can be nested without interference with the horizontal rebar when both are required or desired.

As previously indicated, FIG. 12 illustrates the interlocking action between spurs 53 and recesses 54 of adjacent cores 40. A further function of recesses 54 occurs at the junction between the fresh footing 59 and the first running course of block 20. Thus when block 20 is layed on the footing 59 and the cores 40 are placed in their designated positions, the footing material 59 rises into recesses 54 and, upon setting, will further secure the first running course of block 20 to footing 59.

The formation of conduit channels 24 within the walls of blocks 20 provides ready access for wiring which may be introduced from either the top or the bottom of a wall erected in accordance herewith (see FIGS. 14A–14C). The mason erecting the wall does not need to know the wiring plans for the final building when he creates a wall in accordance herewith. Rather, the electrician will recognize that there are readily available electrical conduit channels 24 incorporated within the wall at regular spacing; for example, eight inches on center, as shown in FIGS. 12 and 14. Thus, electrical wire 60 may be introduced into the wall through conduit 24 and fed to an opening 61 made in the wall by the electrician for the incorporation of a suitable electrical junction box 62 therewithin. The necessary electrical hook up can thereafter be effected using conventional technology and needs no further elaboration here.

As previously described, the present invention provides a further advantage in that it provides the block plant with an inherent method for monitoring the dimensions of blocks 20 created thereat. Thus, if blocks 20 "grow" in length due to wear on the sides of the mold from which they are formed, core 39 will no longer extend beyond the longitudinal bounds of block 20. Thus, when the length of block 20 produced by a mold increases and approaches the length of core 39 (or a suitable replica thereof used for quality control testing), the manufacturer is alerted to the need to refurbish the mold. A further manufacturing advantage arises from the draft of the walls of the cells in block 20 because they provide an immediate release and separation of the mold parts with minimal wear thereon. This effect provides an extended wear life for such mold parts. Nevertheless, such wear is present and is cumulative. As even these mold parts finally wear, the cells within the block will decrease in volume whereupon the precisely dimensioned cores will be observed to not fit intimately within the cells of the block. Again, the cores provide a clear signal to the manufacturer that the mold parts need refurbishing.

Figure 17:
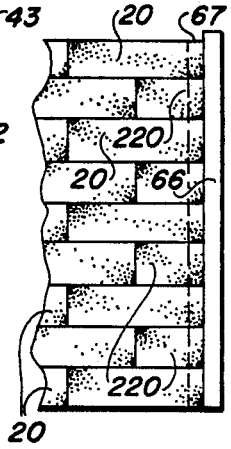
FIG. 17 is a front elevation of a window/door opening framed in accordance with the present invention.

Another important aspect of this disclosure is illustrated in FIGS. 15, 16 and 17 and deals with the easy and convenient manner whereby the present invention is readily adapted to finish corners (see: FIG. 15) and to frame the openings provided for windows and doors (see: FIGS. 16 and 17).

Referring to FIG. 15, each corner block 120 comprises a first and second outside wall 121, 122 having a central web 123 disposed therebetween extending approximately one-half the axial length thereof to a transverse wall 124 extending between walls 121, 122 and coacting therewith and smooth end wall 125 to define a full size grout cell 126 therebetween.

The half block identified in FIG. 16 by numeral 220 is simply one-half of a block 20 (see: FIGS. 1 and 2) and comprises a first and second outside wall 221, 222, respectively, having a central web 223 operatively interposed therebetween. Disposed in cell 226 which is interposed between outer wall 222 and central web 223 is a portion of the longer cell core 39 (as shown in FIG. 9) after it has been cut to conform to cell 226 thereof, such core insert being designated as 239 in FIG. 16. The smaller cores 40 are scored at 50 and can readily and uniformly be broken for use in the half blocks 220 when required.

Referring now to FIG. 17, a typical arrangement which is especially useful for expansion joints or in framing windows and doors using the system of the present invention is shown. Vertical member 66 represents the jamb of the frame of a door or window or fireplace but which can also be the location of an expansion joint. The structure as shown comprises an arrangement involving a plurality of full size blocks 20 mounted in staggered interlocking relationship to each other in the manner already described with a plurality of half blocks 220 interposed therebetween in alternating courses to create a common planar surface having a vertically extending slot 67 therein to receive a support board (not shown) therewith for abutting and supporting member 66 thereagainst. Slot 67 is created by the vertical alignment of the several compartments 32 with each other.

What has been disclosed in a construction block having, inter alia, interior tapered wall cells. The tapering of the walls provides precisely maintained interior geometry for a long life time of use of the molds and parts employed in the manufacture of such block. Insertable cores of precise dimension are provided to fit intimately within such cells and to come into intimate contact with like cells in adjacent blocks in a running course of said blocks and with similar cells in adjacent blocks in adjacent courses of said cells to create a dimensionally exact standing wall which is both self-aligned and self-leveling. The intimate contact of the insertable cores permit the formation of open-gapped interlocks between blocks and running courses, which open-gapped interlocks may be converted to closed-gapped interlocks by coating the wall erected therefrom with surface bonding cement.

The foregoing blocks and cores are readily transformed into a drystacked structure by providing a level base surface on said preselected course; placing a plurality of hollow cell blocks end-to-end on a first row along said course, each of said blocks having a preselected length, width, and height, a first and second outer wall and a central web or wall, said central wall being operatively interposed between said first and second outer wall and presenting a first and second planar surface respectively thereto to define first and second core receiving slots therebetween, said first core receiving slot having a first and a second web disposed transversely thereacross at each end thereof in spaced parallel relationship to each other, said second core receiving slot having a third and a fourth web disposed transversely thereacross in spaced parallel relationship to each other intermediate the ends thereof and coacting therewith to define a first and second open ended compartment adjacent said ends and a relatively closed compartment intermediate said open compartments between said web, each of said transverse webs having a hyperextended draw or V-shaped notch defined therein, said notch having a curvilinear crotch disposed in a fixed preselected spatial relationship to the bottom surface of said block, said blocks being oriented on said course with said open ended compartments of adjacent blocks being in registered communication with each other adjacent the intended interior surface of said wall; placing a first spacer core in each said first core receiving slot in each of said blocks in seated engagement therewithin, each first spacer core having a body portion substantially equal in size to said first core receiving slot and having a V-shaped ear member integrally formed with said body portion at each end thereof for complementary seated engagement within the V-shaped notch of said transverse web contiguous thereto; placing a second spacer core in said relatively closed compartment in said second core receiving slot in seated engagement therewithin, each said spacer core having a body portion substantially equal in size to said relatively closed compartment but wider than said first spacer core, said second spacer core having an inverted V-shaped ear member integrally formed with said body portion at each end thereof for complementary seated engagement within the V-shaped notch of said transverse web contiguous thereto, each said ear member extending outwardly from said body portion a distance equal to one-half the axial length of said V-shaped slot; placing a third spacer core in one of said open compartments in said second core receiving slot and the registered open compartment in the block adjacent thereto to interlock the adjacent blocks in fixed axial relationship to each other, said third spacer core being substantially identical in shape and size to said second spacer core and the V-shaped ears thereof being seated in said V-shaped slots of the contiguous transverse webs; repeating the foregoing steps until the entire first row of blocks and spacer cores are in place along said course; and repeating the entire sequence for the second and subsequent row of blocks along said course until the preselected length and height of said wall is achieved.

From the foregoing it is readily apparent that an invention has been herein described and illustrated which fulfills all of the aforestated objectives in a remarkably unexpected fashion. It is of course understood that such modifications, alterations and adaptations, as may readily occur to the artisan skilled in the field to which this invention pertains when confronted with this specification, are intended within the spirit of the present invention which is limited only by the scope of the claims appended hereto.

Accordingly, what is claimed is:

1. A method for erecting a self-leveling and self-aligning drystacked block wall of preselected length and height upon a preselected course from a plurality of hollow cell blocks and complementary spacer cores, said method comprising the steps of:

(a) providing a level base surface on said preselected course;

(b) placing a plurality of hollow cell blocks end-to-end on a first row along said course, each of said blocks having a top surface, a bottom surface, a preselected length, width, and height, a first and second outer wall and a central wall, said central wall being operatively interposed between said first and second outer wall and presenting a first and second planar surface respectively thereto to define first and second core receiving slots therebetween, said first core receiving slot having a first and a second web disposed transversely thereacross at each end thereof in spaced parallel relationship to each other, said second core receiving slot having a third and a fourth web disposed transversely thereacross in spaced parallel relationship to each other intermediate the ends thereof and coacting therewith to define a first and second open ended compartment adjacent said ends and a relatively closed compartment intermediate said open compartments between said web, each of said transverse webs having a V-shaped notch defined therein said notch having a curvilinear crotch disposed in a fixed preselected spatial relationship to the bottom surface of said block, said blocks being oriented on said course with said open ended compartments of adjacent blocks being in registered communication with each other adjacent the intended interior surface of said wall;

(c) placing a first spacer core in each said first core receiving slot in each of said blocks in seated engagement therewithin, each first spacer core having an upper surface, and a body portion substantially equal in size to said first core receiving slot and a V-shaped ear member integrally formed with said body portion at each end thereof for complementary seated engagement within the V-shaped notch of said transverse web contiguous thereto; to create a uniform and replicable dimension between said bottom surface of said block and said upper surface of said first spacer core;

(d) placing a second spacer core in said relatively closed compartment in said second core receiving slot in seated engagement therewithin, each said spacer core having an upper surface and a body portion substantially equal in size to said relatively closed compartment, each said second spacer core having a V-shaped ear member integrally formed with said body portion at each end thereof for complementary seated engagement within the V-shaped notch of said transverse web contiguous thereto, each said ear member extending outwardly from said body portion a distance equal to one-half the axial length of said V-shaped slot, each said ear members coacting with the V-shaped slot contiguous thereto to create a uniform and replicable dimension between said bottom surface of said block and said upper surface of said second spacer core;

(e) placing a third spacer core in one of said open compartments in said second core receiving slot and the registered open compartment in the block adjacent thereto to interlock the adjacent blocks in fixed axial relationship to each other, each said third spacer core being substantially identical in shape and size to each said second spacer core and the V-shaped ears thereof being seated in said V-shaped slots of said transverse webs contiguous thereto, each said ear member coacting with the V-shaped slot contiguous thereto to create a uniform and replicable dimension between said bottom surface of said block and said upper surface of said third spacer core;

(f) repeating the foregoing steps until the entire first row of blocks and spacer cores are in place along said course; and (g) repeating the entire sequence for the second and subsequent row of blocks along said course until the preselected length and height of said wall is achieved.

2. A method according to claim 1 in which all of said spacer cores are formed of thermally insulating material.

3. A method according to claim 2 in which each said block includes vertically aligned passageways for feeding electrical wire therethrough without disturbing the interaction of said block with said spacer cores.

4. A method according to claim 3 in which said ear members on said first spacer core extend outwardly therefrom a distance substantially equal to axial length of said V-shaped slots.

5. A method according to claim 1 in which each of said second and said third spacer cores in a first course of block are disposed in registered interlocking engagement with corresponding second and third spacer cores in the course of block placed thereupon and supported thereby whereby said spacer cores coact with like spacer cores in abutting arrangement thereto to align and plumb the blocks associated therewith.

6. A method according to claim 5 in which selected one of said second spacer cores in a vertical line and said third spacer cores vertically interposed therewith are omitted from said blocks to define a vertical grout cell therewithin.

7. The method of claim 1 further comprising the step of applying surface bonding cement to the outer surface of the drystacked blocks, aligned and leveled by said cell cores.

8. The method of claim 3 further comprising the step of applying surface bonding cement to the surfaces of the drystacked blocks, aligned and leveled by said cell cores.

9. The method of claim 6 further comprising the step of applying surface bonding cement to the surfaces of the drystacked blocks, aligned and leveled by said cell cores.

10. The drystack block wall produced by the method of claim 7.

11. The drystack block wall produced by the method of claim 8.

12. The drystack block wall produced by the method of claim 9.

13. A self-aligning and leveling insulated drystack block comprising a body portion having a bottom surface, a top surface, a preselected length, width and height, a first outer wall, a second outer wall, and a central wall, said central wall being operatively interposed between said first and second outer wall and presenting a first and second planar surface respectively thereto to define a first and a second core receiving slot respectively therebetween, said first core receiving slot having a first and second web disposed transversely thereacross at each end thereof in spaced generally parallel relationship to each other, said second core receiving slot having a third and fourth web disposed transversely thereacross intermediate the ends thereof in spaced generally parallel relationship to each other and coacting therewith to define a first and a second open ended compartment adjacent said ends and a relatively closed compartment intermediate said open compartment and said webs, each of said webs having a V-shaped notch defined therein, said notch having a curvilinear crotch disposed in a fixed spatial relationship to said bottom surface; a first spacer core for installation into said first core receiving slot having a body portion substantially equal in size to said core receiving slot and having an upper surface and a V-shaped ear member integrally formed with said body potion at each end thereof for complementary seated engagement within the V-shaped notch of said transverse web contiguous thereto to maintain a fixed spatial relationship between said upper surface and said crotch; a second spacer core for installation into said relatively closed compartment in said second core receiving slot, said spacer core having a body portion substantially equal in size to said relatively closed compartment, said second spacer core having an upper surface and a V-shaped ear member integrally formed with said body portion at each end thereof for complementary seated engagement within the V-shaped notch of said transverse web contiguous thereto to maintain a fixed spatial relationship between said upper surface and said crotch, each said ear member extending outwardly from said body portion a distance equal to one-half the axial length of said V-shaped slot.

14. A spacer core for installation in a hollow cored dry stack block comprising an upper surface, a lower surface, and a body portion interposed therebetween, said body portion having a downwardly convergent V-shaped ear member disposed at each end thereof for coaction with said block to position said upper surface relative thereto in readily replicable dimensional relationship therewith, and a pair of generally cylindrical upstanding nodes disposed in spaced relationship to each other on said upper surface thereof.

15. A spacer core according to claim 14 in which a pair of generally cylindrical recesses are defined in said lower surface in complementary relationship to said nodes.

16. A spacer core according to claim 14 in which said body portion has a first and second lateral surface, said first surface being smooth and said second surface comprises a plurality of vertically extending flutes disposed in spaced generally parallel relationship to each other.

17. A spacer core according to claim 15 in which said body portion has a first and second lateral surface, said first surface being smooth and said second surface comprises a plurality of vertically extending flutes disposed in spaced generally parallel relationship to each other.

18. A spacer core according to claim 16 in which said flutes are equispaced from each other.

19. A spacer core according to claim 17 in which said flutes are equispaced from each other.

20. A spacer core according to claim 18 having a vertically extending score defined thereon to permit the division of said core into two substantially identical half cores.

21. A spacer core according to claim 19 having a vertically extending score defined thereon to permit the division of said core into two substantially identical half cores.

* * * * *